US007546990B1

(12) United States Patent
McGuire

(10) Patent No.: US 7,546,990 B1
(45) Date of Patent: Jun. 16, 2009

(54) TOOL HANGER SYSTEM KIT

(76) Inventor: Donnie McGuire, 1318 E. Cruces St., Wilmington, CA (US) 90744

( * ) Notice: Subject to any disclaimer, the term of this patent is extended or adjusted under 35 U.S.C. 154(b) by 161 days.

(21) Appl. No.: 11/853,948

(22) Filed: Sep. 12, 2007

(51) Int. Cl.
*A46B 17/02* (2006.01)

(52) U.S. Cl. ..... 248/111; 248/110; 248/112; 248/113; 248/291.1; 248/294.1; 248/240; 248/242; 248/316.1; 211/70.6

(58) Field of Classification Search ..... 248/110–113, 248/291.1, 294.1, 240, 242, 316.1; 211/13.1, 211/85.7, 60.1, 62, 63, 65, 66, 85.29, 113, 211/118, 70.6
See application file for complete search history.

(56) References Cited

U.S. PATENT DOCUMENTS

| | | | | | |
|---|---|---|---|---|---|
| 254,692 | A | * | 3/1882 | Rath | 248/113 |
| 1,494,777 | A | * | 5/1924 | Dodsworth | 248/113 |
| 1,533,661 | A | * | 4/1925 | Remillong | 248/294.1 |
| 1,736,591 | A | * | 11/1929 | Gregory | 248/113 |
| 1,864,817 | A | * | 6/1932 | Hart | 248/113 |
| 2,051,408 | A | * | 8/1936 | Karst | 211/65 |
| 2,413,839 | A | * | 1/1947 | Menzel | 248/113 |
| 2,489,875 | A | * | 11/1949 | Embree | 248/113 |
| 2,616,143 | A | * | 11/1952 | Falkner | 248/113 |
| 2,740,532 | A | * | 4/1956 | Kleinsmith | 211/104 |
| 2,911,172 | A | * | 11/1959 | Clayton et al. | 248/113 |
| 2,952,366 | A | * | 9/1960 | Botten | 211/104 |
| 3,233,745 | A | * | 2/1966 | Hershberger | 211/104 |
| 3,484,069 | A | * | 12/1969 | Larson | 248/220.42 |
| 3,633,860 | A | | 1/1972 | Navarro | |
| 4,146,204 | A | * | 3/1979 | Thalenfeld | 248/220.41 |
| 4,286,717 | A | | 9/1981 | Liesinger | |
| 4,519,566 | A | | 5/1985 | Manzi | |
| 4,880,192 | A | | 11/1989 | Vom Braucke et al. | |
| 4,909,467 | A | * | 3/1990 | Shan-Pao | 248/312 |
| 5,116,003 | A | * | 5/1992 | Gerhardt | 248/312 |
| 5,322,256 | A | * | 6/1994 | Kanwischer | 248/312 |
| 5,346,168 | A | * | 9/1994 | Astrella | 248/278.1 |
| 5,372,346 | A | * | 12/1994 | Upchurch et al. | 248/304 |
| 5,590,795 | A | * | 1/1997 | Wright | 211/104 |
| 5,662,254 | A | * | 9/1997 | Lemajeur et al. | 224/405 |
| 5,839,589 | A | * | 11/1998 | Hillard | 211/70.6 |
| 5,865,410 | A | * | 2/1999 | Horen | 248/242 |
| 6,295,945 | B1 | * | 10/2001 | Amanze | 116/173 |
| 6,823,999 | B2 | * | 11/2004 | Heneveld, Sr. | 211/87.01 |

* cited by examiner

*Primary Examiner*—J. Allen Shriver, II
*Assistant Examiner*—Michael McDuffie
(74) *Attorney, Agent, or Firm*—Crossley Patent Law; Mark A. Crossley

(57) ABSTRACT

A tool hanger system kit used to secure a tool, such as a mop, broom, or other tool, to a wall which includes an all-purpose handle clamp that is easily and readily removably attached to a tool handle and a wall mount having arms pivotally extending outwardly therefrom for receiving a tool mounted to a handle clamp is disclosed.

5 Claims, 3 Drawing Sheets

TOOL HANGER SYSTEM KIT

FIELD OF THE INVENTION

The present invention relates to tool hanger devices and, more specifically, to a tool hanger system kit used to secure a tool, such as a mop, broom, or other tool, to a wall which includes an all-purpose handle clamp that is easily and readily removably attached to a tool handle and a wall mount having arms pivotally extending outwardly therefrom for receiving a tool mounted to a handle clamp.

BACKGROUND OF THE INVENTION

A wide variety of tool hanging devices are offered in prior art. One such device provides a broom-holder consisting of a socket and a rubber ring for holding a broom. Another device teaches a brush or broom support that has a shank terminating at one end in a pair of integral horns, the horns being curved and extending toward each other at their ends to prevent the article held by them from being withdrawn by passing it between the ends of the horns. Still another device teaches a mop and broom holder having an L-shaped mounting bracket having slots formed in a horizontal flange portion for receiving an article to be held. Conformingly positioned jaw members are pivotally mounted on the bracket and are spaced over lateral edges of the slots to allow the passage of an article through the slots. Bias means are connected to the jaw members for automatically urging them into clamping engagement with the article as it passes between the jaw members. The foregoing devices illustrate a few of the prior art tool hanging devices.

The present tool hanger system kit discloses a simple all-purpose handle clamp that is easily and readily removably attached to the handle of various tools, as well as a mounting bracket which affixed to a wall for receiving and holding a tool by its handle, thereby improving space utilization and improving organization.

SUMMARY OF THE INVENTION

The present tool hanger system kit is used to secure a tool, such as a mop, broom, or other tool, to a wall. This kit improves space utilization and organization in any household, garage or industrial environment. The present tool hanging system includes an all-purpose handle clamp that is easily and readily removably attached to the handle of such tools and, in addition, a companion piece that would be affixed to the wall via securing means, such as screws and predrilled holes in the material. This handle clamp may be formed from a suitable material such as metal or plastic and can accommodate various sizes and shapes of handles. The present tool hanger system kit organizes tools and thereby eliminates a time-consuming search for a broom, mop, or other tool and helps to keep cleaning and other types of tools neat and clean because the tools are maintained in an elevated position. The present tool hanger system is lightweight, reusable, reasonably priced, convenient, simple to install, and durable.

In one alternative embodiment, the present tool hanging system kit includes a mounting bracket, a handle clamp, and screws. In another alternative embodiment, the present tool hanging system kit further provides a hook that is produced from metal or plastic, depending on the weight of the object that needs to be hung. The kit provides a clamp (in one instance it is dome-shaped) for attachment to the top of a tool (e.g. a rake). The preferred embodiment provides a mounting bracket which measures approximately 2 inches to 4 inches wide and 1 to 2 inches tall and is designed to accommodate various shapes and sizes of tools.

In still another alternative embodiment, the present tool hanging system allows a user to attach the clamp to the end of a handle of a tool and then slip the clamp into the companion piece.

In yet another alternative embodiment, the present tool hanging system allows users to adjust the vertical location of the tool on the wall such that various adjacent tools can be positioned in a manner where storage is optimized.

The present tool hanging system is provided in various sizes and various colors.

One object of the present tool hanger system is to keep long-handled cleaning tools neat and organized Another object of the present tool hanger system is to eliminate unsightly clutter inside homes, garages, storage buildings, and other types of structures.

Yet another object of the present tool hanger system is to make it easier to select a cleaning tool for a household or outdoor task.

Yet another object of the present tool hanger system is to save space in the area in which it is installed.

Yet another object of the present tool hanger system is to make it easy to set up and use with mops, rakes, brooms and shovels.

Thus has been broadly outlined the more important features of the improved tool hanger system kit so that the detailed description thereof that follows may be better understood and in order that the present contribution to the art may be better appreciated.

These together with additional objects, features and advantages of the improved tool hanger system kit will be readily apparent to those of ordinary skill in the art upon reading the following detailed description of presently preferred, but nonetheless illustrative, embodiments of the improved tool hanger system kit when taken in conjunction with the accompanying drawings. In this respect, before explaining the current embodiments of the improved tool hanger system kit in detail, it is to be understood that the invention is not limited in its application to the details of construction and arrangements of the components set forth in the following description or illustration. The present kit is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved tool hanger system kit. It is therefore important that the claims be regarded as including such equivalent constructions insofar as they do not depart from the spirit and scope of the present invention.

Objects of the improved tool hanger system kit, along with various novel features that characterize the invention are particularly pointed out in the claims forming a part of this disclosure. For better understanding of the improved tool hanger system kit, its operating advantages and specific objects attained by it uses, refer to the accompanying drawings and description.

DETAILED DESCRIPTION OF THE DRAWINGS

Figure 1:
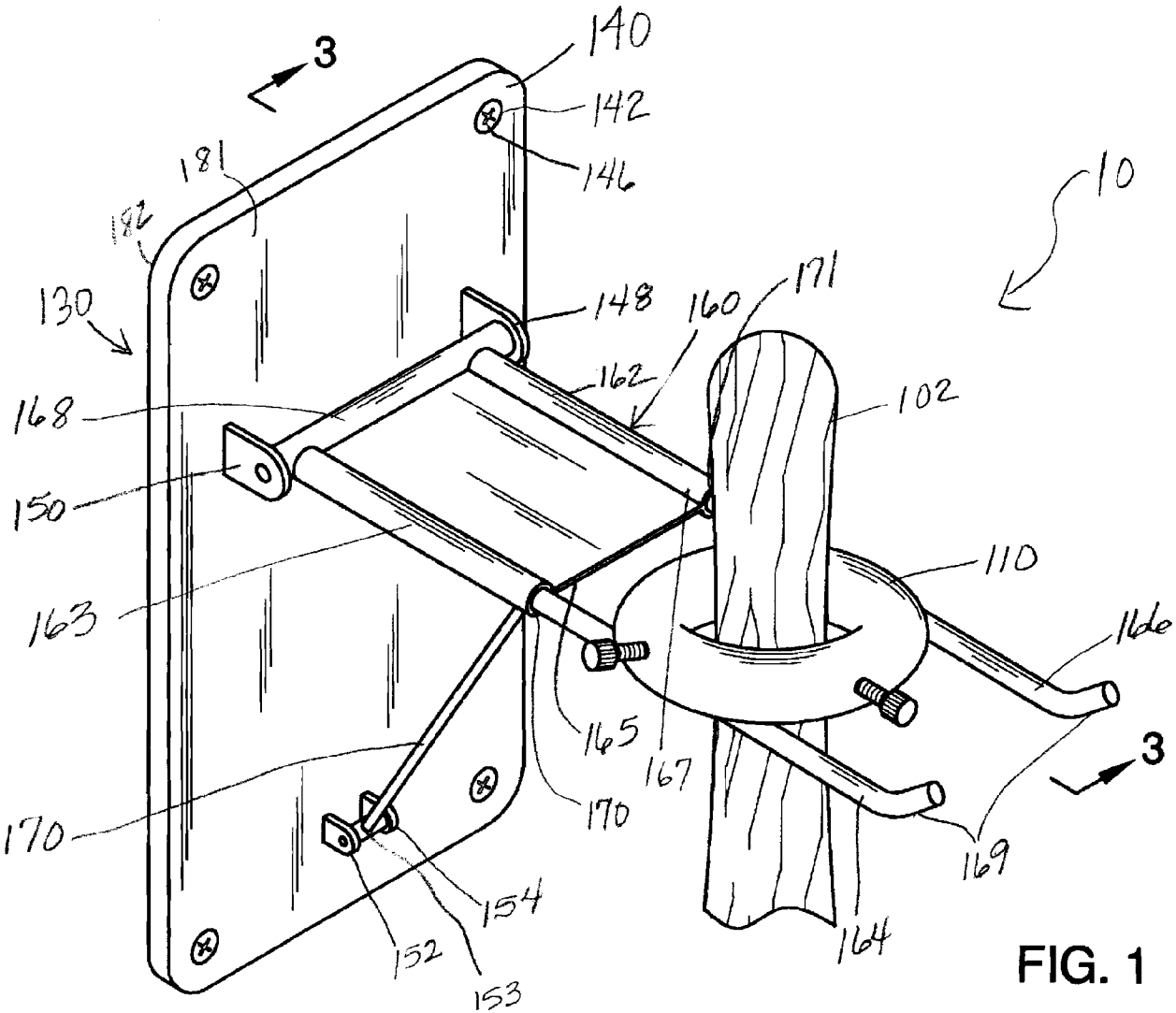
FIG. 1 is an isometric view.
Figure 2:
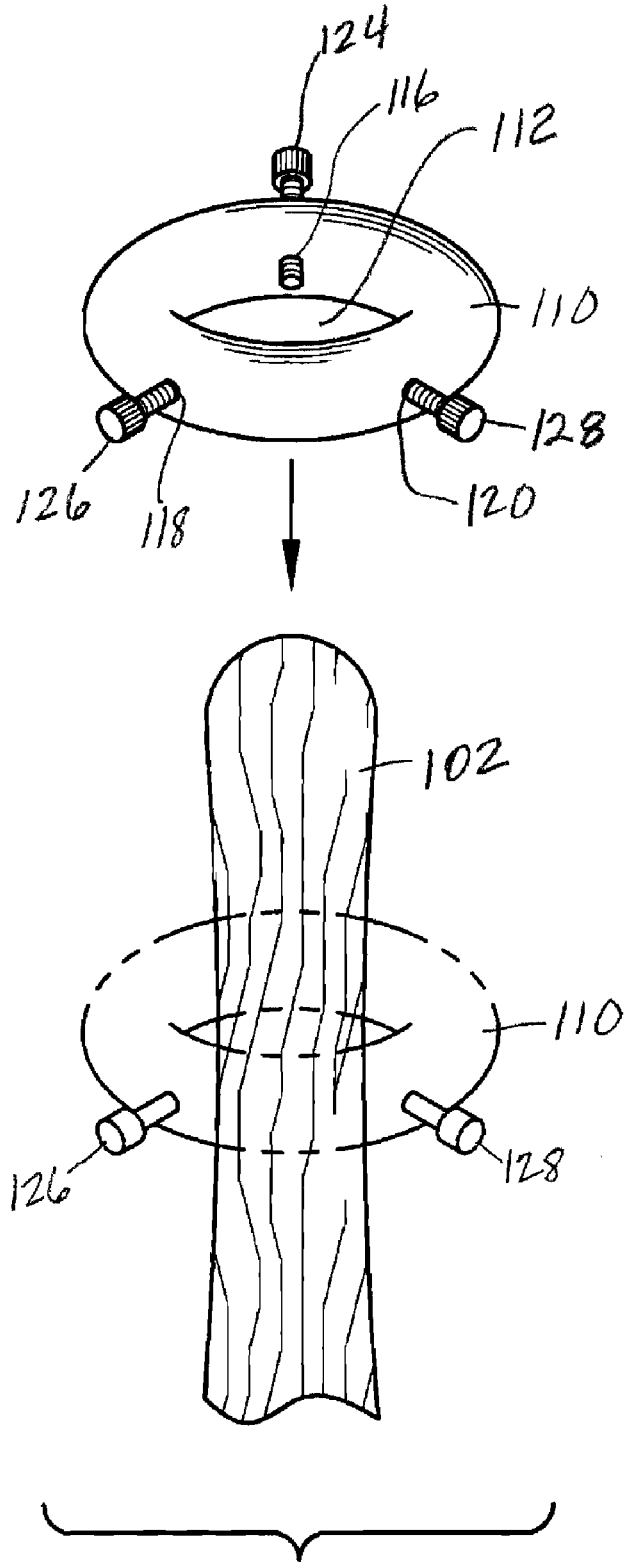
FIG. 2 is an isometric view of a dome piece.
Figure 3:
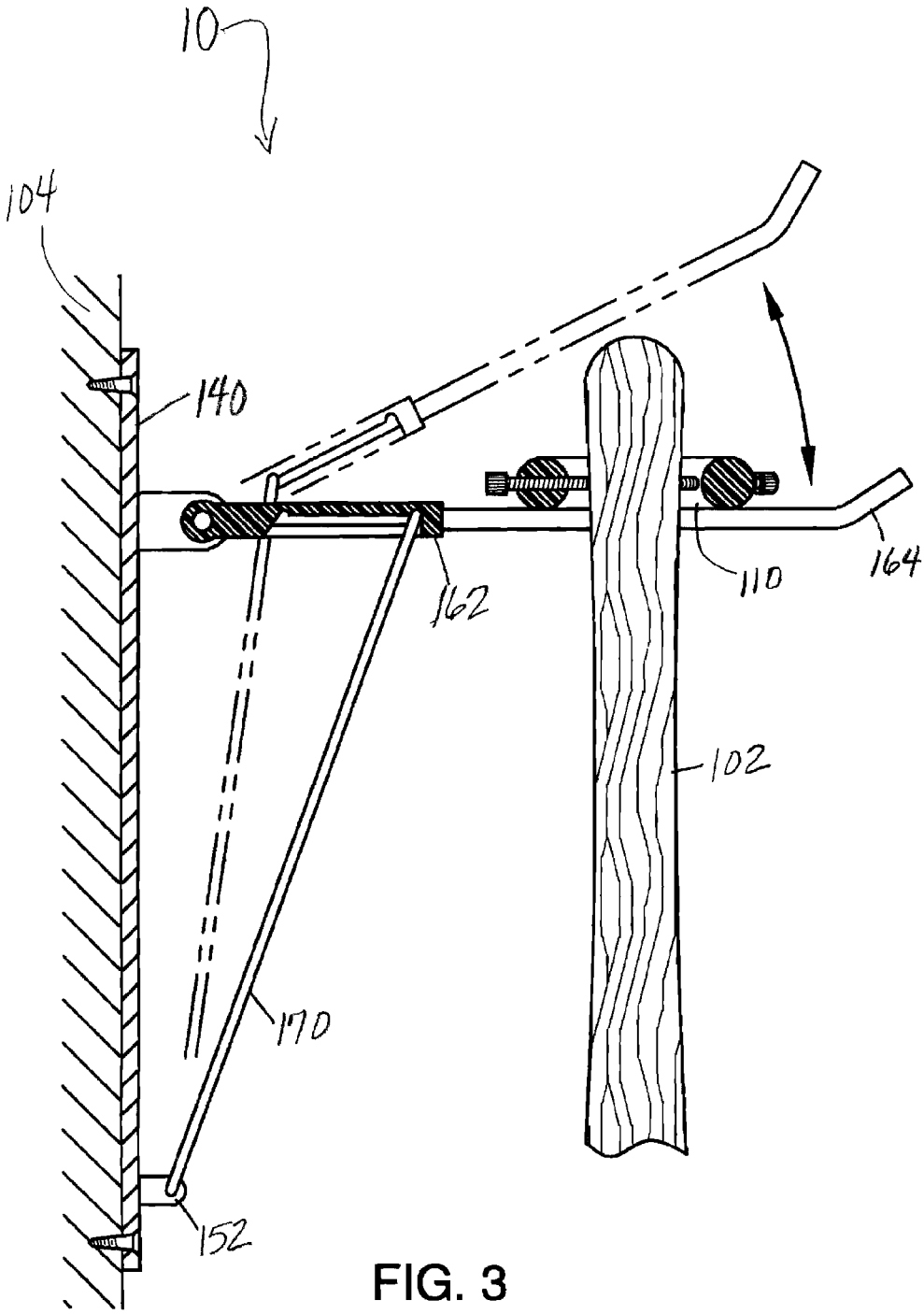
FIG. 3 is an in-use side elevation view.

With reference now to the drawings, and in particular FIGS. 1 through 3 thereof, examples of the employing the principles and concepts of the present tool hanger system kit, generally designated by the reference number 10, will be described.

FIG. 1 illustrates an isometric perspective view of the tool hanger system kit 10 which generally comprises a handle clamp 110 and a wall mount 130. The kit 10 is generally used to secure a tool 102 to a wall 104, as shown in FIG. 3.

With continued reference to FIG. 1, the wall mount 130 may be provided with a wall bracket 140 having a front side 181 and a rear side 182. The wall bracket 140 is a generally flat rectangular shape as illustrated or, alternatively, may take any of a variety of shapes. In one exemplary embodiment, the wall bracket 140 is provided with a plurality of holes 142 for receiving a plurality of screws 146 as illustrated. The wall bracket 140 may be further provided with a pair of pivotal protrusions 148 and 150 outwardly extending from the upper front side 181 of said wall bracket 140 and pivotally connected to each other by a cylindrical pin 168 therebetween. The wall bracket 140 may be further provided with a pair of leg protrusions 152,154 outwardly extending from the lower front side of said wall bracket. The leg protrusions 152, 154 are pivotally connected to each other by means of a cylindrical piece 153. The wall mount 130 may be further provided with an outwardly extending tool hook 160. The tool hook 160 may be provided with a base portion 162 and a pair of outwardly extending arms 164, 166. The base portion 162 is generally rectangular and has a first cylindrical outer edge 163 having a first aperture 170 on a distal end 165 and a second cylindrical outer edge 167 having a second aperture 171 also on a distal end 165. The arms 164, 166 are tubular and have an upwardly turned outer end 169. FIG. 1 illustrates said arms 164, 166 insertedly attached into a first aperture 170 and a second aperture 171, respectively. FIG. 1 further illustrates a base portion 162 which is pivotally attached to the wall bracket 140 via the pair of pivotal protrusions 148, 150. The wall bracket 140 may be further provided with a support leg 170. This support leg 170 may be constructed of any of a number of types of materials; however, in one exemplary embodiment, the support leg 170 is made of metal, such as steel. This support leg 170 may be slidingly engaged to the base portion 162 as illustrated in FIG. 3. Furthermore, the support leg 170 is pivotally attached to the wall bracket 140 via the pair of leg protrusions 152, 154.

With reference to FIG. 2 illustrating an isometric perspective view of the handle clamp 110 and the tool 102 in an exploded condition (the as-installed condition of the handle clamp 110 on the tool 102 is illustrated with a phantom line representation of the handle clamp 110), the handle clamp 110 is configured to interface with the tool 102. Although a variety of devices may be employed to attach the handle clamp 110 to the tool 102, one exemplary embodiment is now described. The handle clamp 110 may take a generally doughnut shape wherein a thru-hole 112 is able to receive the tool 102. The handle clamp 110 may be further provided with a plurality of equidistantly spaced-apart holes 116, 118, 120 such as individual holes 116, 118, 120. These holes 116, 118, 120 may be configured such that their theoretical axes meet at the center of the thru-hole 112. These holes 116, 118, 120 may also be formed with threads (not shown) such that they are capable of threadingly engaging screws. The handle clamp 110 may be further provided with a plurality of individual screws 124, 126 and 128. As illustrated in FIG. 2, these screws 124, 126, 128 are interchangeably positioned in the holes 116, 118, 120. In the as-installed condition illustrated in FIG. 2 by a phantom line (and also in FIGS. 1 and 3) the handle clamp 110 is secured to the tool 102 at a positioned determined by the user of the tool 102.

With reference to FIG. 3 showing an isometric perspective of a cutaway portion of the present tool hanger system kit 10 taken along line 3-3 of FIG. 1, the tool 102 with the handle clamp 110 attached thereto is positioned and supported by the extending arms 164, 166. As can be appreciated by those skilled in the art, the handle clamp 110 can be positioned at any spot on the tool 102 so as to adjust the height of the tool 102 on the wall 104.

With continued reference to FIG. 3, the wall bracket 140 usually has the outwardly extending arms 164, 166 protruding from the wall 104. If required for various reasons, such as convenience, the extending arms 164, 166 can be pivoted into a position that is generally parallel to the wall 104 as illustrated by the phantom line in FIG. 3. This position may be referred to herein as an as-stored condition wherein the extending arms 164, 166 are parallel to the wall 104. Likewise, the present tool hanger system kit 10 also has an as-used condition wherein the extending arms 164, 166 are generally perpendicular to the wall 104.

Having provided detailed a description of one exemplary embodiment of the present tool hanger system kit 10, the process of using the tool hanger system kit 10 will now be provided. The user begins by positioning the handle clamp 120 at a desired position on the tool 102. The screws 122 are tightened so that they secure the handle clamp 120 to the tool 102 as illustrated in FIGS. 1, 2 and 3. Once the handle clamp 120 is positioned on the tool 102, the user positions the tool 102 between the extending arms 164, 166 and lowers the tool 102 until the handle clamp 120 comes into contact with the extending arms 164, 166. The tool 102 remains in this position until it is needed. When needed, the user removes the tool 102 from the wall mount 130. At that time, the user may desire to place the extending arms 164, 166 into the as-stored condition until the user desires to hang the tool 102 again and the process is reversed.

It should be apparent the present tool hanger system kit 10 secures a tool 102 to the wall 104 to improve space utilization and organization in any location by providing a handle clamp 120 that easily (and readily removably) attaches to the tool 102. A plurality of tools 102 secured in accordance with the present kit 10 are organized and thereby eliminating a time-consuming search for a tool and keeping the area neat, clean, and organized.

In one alternative embodiment, the present tool hanging system kit 10 includes the wall mount 140, the handle clamp 110 and screws 124, 126, 128.

In another alternative embodiment, the present tool hanging system kit 10 has a hook 110 that is produced from metal or plastic, depending on the weight of the object that needs to be hung. This embodiment is provided with a handle clamp 110 for attachment to the top of a tool 102, such as a rake or broom.

In yet another alternative embodiment, the present tool hanging system kit 10 is provided wherein the wall mount 130 measures approximately 2 inches to 4 inches wide and 1 to 2 inches tall and is designed to accommodate various shapes and sizes of tools.

In still another alternative embodiment, the present tool hanging system kit 10 allows a user to attach the handle clamp 110 to the end of a handle of a tool 102 and then slip the clamp 110 into the wall mount 140.

In yet a further alternative embodiment, the present tool hanging system kit 10 allows users to adjust the vertical location of the tool 102 on the wall 104 such that various adjacent tools can be positioned in a manner where storage is optimized.

In a still further alternative embodiment, the present tool hanging system kit 10 is produced in various sizes and various colors.

With respect to the above description then, it is to be realized that the optimum dimensional relationships for the parts of the tool hanger system kit 10 to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A tool hanger system kit to secure a tool to a wall comprising:

a handle clamp; and a wall mount having a front side and a rear side, said wall mount further comprising a wall bracket further comprising:

means for mounting said wall bracket to a wall;

a pair of pivotal protrusions outwardly extending from the upper front side of said wall bracket, said pivotal protrusions pivotally connected to each other by a cylindrical pin therebetween;

a means for bracing said wall bracket;

a tool hook comprising:

a pair of outwardly extending arms, said arms being tubular and having an upwardly turned outer end;

a rectangular base portion pivotally attached to said wall bracket by said pivotal protrusions, said base portion further providing a means for receiving said pair of arms.

2. The tool hanger system kit of claim 1 wherein:

said handle clamp is doughnut shaped wherein a thru-hole is able to receive a tool, said handle clamp having a plurality of equidistantly spaced-apart holes configured in a manner that the theoretical axes of said holes meet at the center of said thru-hole, each of said holes for threadingly engaging a screw;

said wall bracket is flat and rectangular;

said means for mounting said wall bracket to a wall is a plurality of screws and a plurality of holes for receiving said plurality of screws;

said means for bracing said wall bracket comprises:

a pair of leg protrusions outwardly extending from the lower front side of said wall mount, said leg protrusions pivotally connected to each other by means of a cylindrical piece; and a support leg pivotally attached to said wall bracket via said leg protrusions and slidingly attached to said base portion;

said means for receiving said a pair of arms comprises:

a first cylindrical outer edge having a first aperture on a distal end; and a second cylindrical outer edge having a second aperture on a distal end.

3. The tool hanger system kit of claim 2 further comprising a plurality of screws for interchangeable threading engagement with said holes of said handle clamp.

4. The tool hanger system kit of claim 2 wherein said support leg is constructed of metal.

5. A method of using the tool hanger system kit of claim 2 comprising the steps of:

positioning said handle clamp at a desired position on a tool;

tightening said screws into holes of said handle clamp to secure the handle clamp to said tool;

positioning said tool between said arms;

lowering said tool until said handle clamp comes into contact with said arms;

removing said tool from said wall mount; and pivoting said arms into a position that is generally parallel to a wall until a user desires to hang a tool on said arms.

* * * * *